United States Patent [19]

Garciá

[11] Patent Number: 5,046,205

[45] Date of Patent: Sep. 10, 1991

[54] INFLATABLE RING CUSHION DEVICE

[76] Inventor: Luis A. Garciá, 530 SW - 42 Ave. Apt. 13, Miami, Fla. 33134

[21] Appl. No.: 124,716

[22] Filed: Oct. 26, 1987

Related U.S. Application Data

[63] Continuation-in-part of Ser. No. 912,384, Sep. 26, 1986, abandoned.

[51] Int. Cl.[5] ..... A47C 20/00

[52] U.S. Cl. ..... 5/431; 4/456; 5/454

[58] Field of Search ..... 4/456; 5/449, 451, 453, 5/454, 431

[56] References Cited

U.S. PATENT DOCUMENTS

| | | | |
|---|---|---|---|
| 1,746,953 | 2/1930 | McCollum | 4/239 X |
| 2,119,687 | 6/1938 | Rexroad | 5/453 X |
| 2,246,205 | 6/1941 | Gray | 4/456 |
| 2,466,142 | 4/1949 | Yost | 4/456 |
| 2,750,600 | 6/1956 | Mac Donald | 4/456 X |
| 2,785,419 | 3/1957 | Walker | 5/431 X |
| 3,008,153 | 11/1961 | Coulter | 4/456 X |
| 3,514,793 | 6/1970 | West | 4/456 |
| 3,628,197 | 12/1971 | Leventhal et al. | 4/456 X |
| 3,939,502 | 2/1976 | Miller | 4/456 |

FOREIGN PATENT DOCUMENTS

| | | | |
|---|---|---|---|
| 769792 | 3/1957 | United Kingdom | 4/453 |

*Primary Examiner*—Charles E. Phillips
*Attorney, Agent, or Firm*—J. Sanchelima

[57] ABSTRACT

An inflatable ring cushion device that includes a toroid shape inflatable cushion, a hose connected to the cushion and to an air pump through a T-coupler. The air pump has a one way valve and the T-coupler includes an air release valve to deflate the cushion as desired. A metal ring rigidly mounted to the T-coupler permits a user to removably attach it to the user's garment.

4 Claims, 1 Drawing Sheet

INFLATABLE RING CUSHION DEVICE

OTHER RELATED MATERIALS

This is a continuation-in-part of application Ser. No. 912,384 filed on Sept. 26, 1986, now abandoned.

BACKGROUND OF THE UNRELATED ART

1. Field of the Invention

This invention relates to devices for individuals who suffer from a rectum disease, e.g., hemorrhoids or piles, as they are also known.

BACKGROUND

In the past, people suffering from hemorrhoids, or other rectum diseases, had to carry with them a cushion in order to avoid pain or more damage to the already injured area when they wanted to sit on a hard surface such as a chair or the like. This brought out not only the uncomfortable situation of carrying an object in their hands, but also the cushion had to be exposed, causing embarrassment.

SUMMARY OF THE INVENTION

It is one of the main purposes of the present invention to provide a device that can inconspicuously relieve users suffering pain in their buttocks area when seated.

It is another object of this invention to provide such a device that is light, volumetrically efficient, and suitable to be removably attached inside a users' garment.

DETAILED DESCRIPTION OF THE PREFERRED EMBODIMENT

Basically the system comprises a hand operated rubber pump of the bulbous type, conveniently located inside the garments, and an inflatable rubber cushion ring, having a doughnut shape, connected to said pump by means of a flexible rubber hose of some length and to an air control "T" plastic coupler containing a non-return inlet valve and an exhaust valve of the stem type to deflate the cushion ring when not in use.

Figure 1:
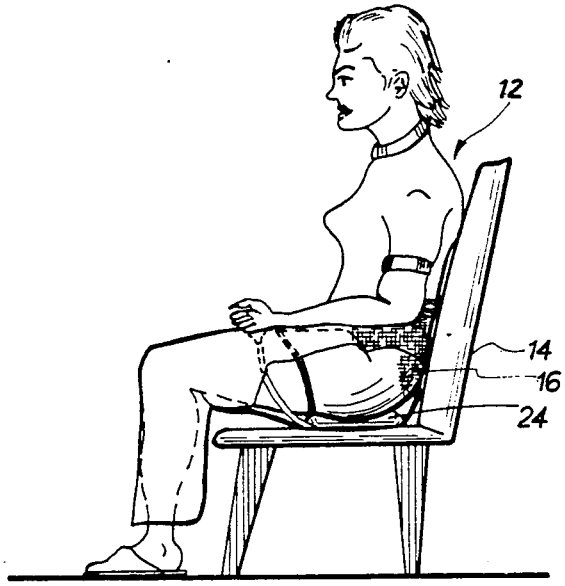
FIG. 1 is an elevation view illustrating the present invention.

The cushion ring has a double faced adhesive tape stuck over a flat, non-inflatable, washer shape, stiff rubber base molded in one side of said cushion, this side is stuck to the appropriate place in the underwear of a wearer, so that the person may inflate the ring and the anal zone of the body will not come in contact with a hard surface. FIG. 1 in the drawings is a general view of a person 12 seated on a chair 14 and carrying the system inside the garments. Actually the person 12 is seated over the inflated cushion 24 attached to her underwear 16.

Figure 2:
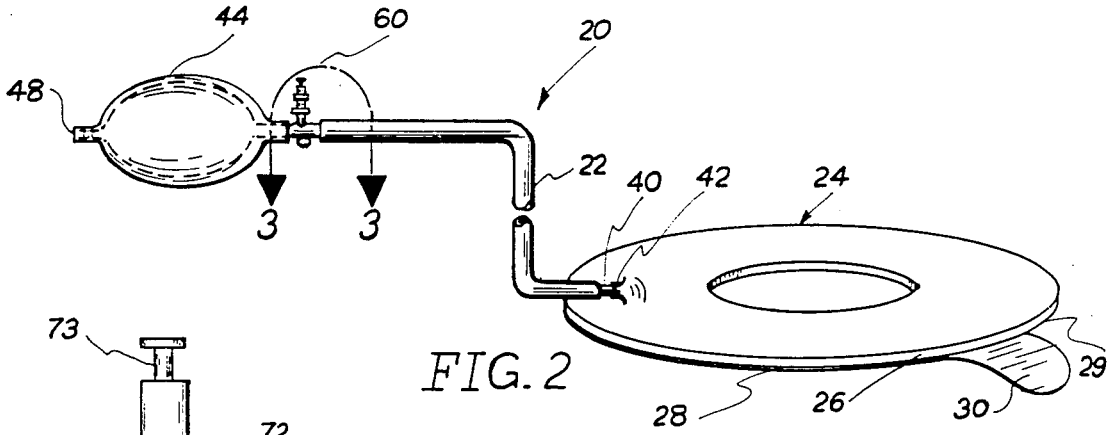
FIG. 2 is a view of the invention assemble.

Referring to FIG. 2 in the drawings wherein the Inflatable Ring Cushion Device generally is designated with numeral 20, it includes four parts:

1) Hand pump 44, preferably of the bulbous type, with its corresponding one-way air admission valve 48 located in the back of the body of said pump. The hand pump 44 can be molded out of resilient natural or synthetic rubber, very much like the one used in sphygmomanometers.
2) Small air control T-coupler 60 with communicating tubular members and made of plastic or aluminum.
3) Thin flexible hose 22 of appropriate dimensions and made of natural or synthetic rubber.
4) Inflatable-deflatable tubular cushion 24 with a doughnut shape in which its outside diameter is circumscribed to an area in the buttocks and the diameter of the center hole of said cushion is given by the average of the normal distance range between both ischium epiphysis in the hipbone of the human skeleton, delimiting the area of said hole. Those facts makes the cushion sufficiently small and light to be carried attached to the underwear. For the sake of clarity, the drawings do not show a removable cloth sheath covering the contour of the inflatable body of the tubular ring 24 as a protector to said ring and mainly to limit the amount of air pumped to said ring. This sheath could be made of nylon cloth of the type used in life jackets, for instance.

Figure 3:
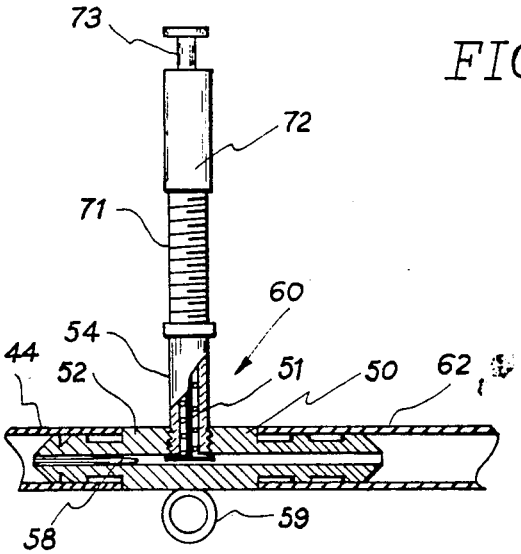
FIG. 3 is a view in cross-section taken in the zone indicated by the arrowed line 3—3 of FIG. 2.

Making reference to FIG. 3 in the drawings, the air control T-coupler 60 is composed of the following members:

(a) A short and empty tubular member 50 with external circumferential grooves to help retain said member in position and used as connection means only.

(b) Another short tubular member 52 with external circumferential grooves and containing inside a non-return inlet valve 58 similar to one used in the sphygmomanometer's air control system.

(c) Large tubular member 54 with screw threads outside the top 1/3 portion of its body, and containing inside an air exhaust valve 71 of the stem type, similar to one used in the inner rubber tube of an automobile's tire. This valve in member 34 removes the air from ring 24 by means of a pressure rod/extension 72 screwed to large member 54.

For the sake of clarity, the drawings do not show said extension which is composed of a plastic hollow body with screw threads inside said body and containing a centered rod with an anchored helicoidal spring and manually operated said rod to exhaust the air from the ring 24 when it presses the stem of the exhaust valve 71.

(d) Small steel ring 59 preferably welded on top of the T-coupler 60, where the members 50, 52 and 54 join together.

Figure 4:
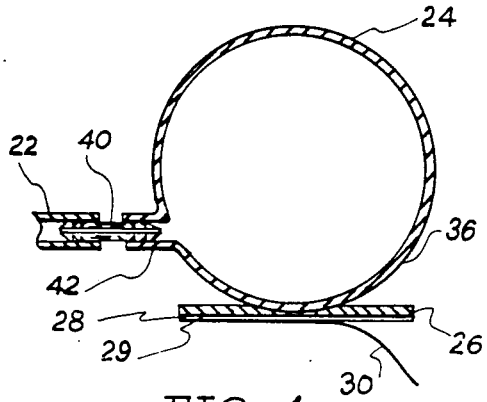
FIG. 4 is a partial view in cross-section illustrating the right-hand portion of FIG. 2 in the inflated mode.

Making reference to FIG. 4 in the drawings, it can be observed how tubular cushion 24 is connected to hose 22.

Inflatable tubular ring 24 made preferably of resilient natural or synthetic rubber similar to the type used in automobile tires' inner tube. Said ring 24 is inflated or exhausted by way of a rubber nipple 42.

Non-inflatable, flat washer shape stiff rubber base 26 with the same perimeter as the ring 24 in the exhausted condition, said base 26 is made of one piece vulcanized to one side of the tubular ring 24 or as one piece molded on side 36 of said ring. The surface of the bottom part of flat base 26 will be rough as to allow stick securely the disposable double faced adhesive tape 28 with a removable liner 30 covering the outer adhesive face.

Separate plastic or aluminum nipple 40 with external circumferential grooves to help retain said nipple 40 in position when it interconnects the rubber nipple 42 of the ring 24 and rubber hose 22. Inflatable Ring Cushion 20 is a fast assembling device. In FIG. 2, one end of the flexible hose 22 is connected to rubber nipple 42 in tubular ring 24 by means of independent nipple 40 and the other end 62 of flexible hose 22 is connected to short and empty tubular member 50 in T-coupler 60. Hand pump 44 is connected to the other short tubular member 52 containing the non-return inlet valve 58 in said coupler 60. Finally, one side of disposable double faced adhesive tape 28 is stuck to the bottom surface of the stiff rubber base 26 of the ring 24.

For men, cushion 24 can be attached to the inside or outside of either the boxer or the athletic type of underwear, depending on the comfort desired.

For women, cushion 24 can be worn inside the panties although in many instances, as shown in FIG. 1, it can be used on the outside of the panties 16, when wearing slacks, long shorts, etc.

To set the device in place, peel outer liner 30 covering the adhesive of tape 28 and stick the flat, deflated cushion 24 to the underwear so as to encircle the anal zone.

T-coupler 60 with the hand pump 44 connected to the flexible hose 22 is routed internally through the garments and removably attached with a safety pin using small ring 59 to the lateral part of the outside of the right or left front pockets in men's pants, just between the pocket's cloth and the pant's cloth.

For women, T-coupler 60 can be attached in a convenient place inside the skirt within [hand] reach.

Just before sitting down, the person introduces a hand in the prepared pocket to squeeze and release manually several times pump 44 to inflate cushion 24 until it is hard enough to support the person's weight, the Nylon sheath will limit the amount of air pumped. In the case of a woman wearing a skirt, she actuates hand pump 44 from outside the skirt.

After the person stands up, he or she presses pressure rod extension 72 to the stem of the exhaust valve 71 mounted inside the large tubular member 54 of the T-coupler 60, much as one does in a conventional automobile tire valve, to let escape the air from cushion 24.

The Inflatable Ring Cushion Device can be easily modernized according to well known techniques; this is unquestionable since the unique embodiment of its parts is not disturbed. In FIG. 2 in the drawings, following the same order of mechanical connections of the parts, a programmed microcomputer to control electronically the sequence of operation of all the electrical components interconnected, is physically attached to the body of a midget electrical air pump with a normally open (N.O.) momentary switch, substituting said pump the manual pump 44; the air exhaust valve 71 is substituted by an air exhaust valve of the electric type; a pressure sensing element like the solid-state strain gauge type, for instance is hermetically mounted in a hole made in either flat side of T-coupler 60, at the center point where the members of said coupler meet. A small battery will provide the necessary electrical energy to operate the system.

Just before sitting down, a person wearing the electrically driven device presses the momentary switch to connect the computer and start the pump to inflate the cushion 24 until a specific pressure is reached, now he is ready to sit and the computer circuit takes control over the pressure valve inside said cushion, while at the same time keeps the exhaust valve closed as long as the specific pressure is maintained by the wearer's weight over the cushion 24.

When a person stands up, the pressure on the inflated cushion 24 and in the sensing element are decreased, thus this will indicate the computer to order the exhaust valve to open, allowing the air to escape from said cushion 24. Therefore, it is to be understood that the basic embodiment of the device can be automated without departing from the spirit of the invention as set forth in the appended claims. Such automation are within the scope of this invention.

What is claimed is:

1. An inflatable ring cushion device, comprising:

A. an inflatable toroid shaped cushion having a center hole, said cushion having dimensions that substantially coincide with the buttocks area of a user and said cushion including a rubber nipple to permit the passage of air to said cushion, a flat annular-shape stiff rubber base molded on one side of said cushion end having a rough bottom surface molded on one side of said base;

B. a rubber hose having two ends and one of said ends being connected to said nipple;

C. a T-coupler having a ring mounted thereon and said T-coupler further including first, second and third connecting tubular members and said first tubular connection being connected to the other end of said hose, and said second tubular member includes an air exhaust valve of the stem type housed therein for releasing the air inside said cushion when activated, said ring being mounted at the periphery to the head of said T-coupler between said first and third tubular members;

D. a manually operated rubber bulbous pump having a one-way air admission valve, said pump being connected to said third tubular member and so arranged and designed to permit the pumping of air through said third and first tubular members and said hose into the inside of said cushion and wherein said T-coupler may be removably attached to the inside of the garment of a user by insertion of an attachment device through said ring when said cushion is placed inside said garment.

2. The inflatable ring cushion device set forth in claim 1 further including a cloth sheath covering said cushion.

3. The inflatable ring cushion device put forth in claim 2 wherein the dimensions of said inflatable toroid shape cushion and the amount of air pumped in are sufficient to prevent the anal area of the users' buttocks from contacting the seat where a user is seated when said cushion is inflated.

4. The inflatable ring cushion device set forth in claim 3 wherein said cushion is made out of rubber.

* * * * *